US011980932B2

(12) United States Patent
Spatz

(10) Patent No.: US 11,980,932 B2
(45) Date of Patent: May 14, 2024

(54) METHOD OF PRODUCING METAL STRANDS AND APPARATUS FOR PRODUCING METAL STRANDS

(71) Applicant: Max-Planck-Gesellschaft Zur Förderung Der Wissenschaften E.V., Munich (DE)

(72) Inventor: Joachim P. Spatz, Stuttgart (DE)

(73) Assignee: Max-Planck-Gesellschaft, Zur Förderung Der Wissenschaften E.V., Munich (DE)

( * ) Notice: Subject to any disclaimer, the term of this patent is extended or adjusted under 35 U.S.C. 154(b) by 0 days.

(21) Appl. No.: 17/609,997

(22) PCT Filed: May 11, 2020

(86) PCT No.: PCT/EP2020/063026
§ 371 (c)(1),
(2) Date: Nov. 9, 2021

(87) PCT Pub. No.: WO2020/229400
PCT Pub. Date: Nov. 19, 2020

(65) Prior Publication Data

US 2022/0212252 A1 Jul. 7, 2022

(30) Foreign Application Priority Data

May 10, 2019 (EP) ..... 19173835
May 21, 2019 (EP) ..... 19175749

(51) Int. Cl.
*B22D 13/10* (2006.01)
*B22D 39/00* (2006.01)
(Continued)

(52) U.S. Cl.
CPC ..... *B22D 13/101* (2013.01); *B22D 13/105* (2013.01); *B22D 39/00* (2013.01);
(Continued)

(58) Field of Classification Search
CPC ..... B22F 1/062; B22F 9/10; B22D 13/105; B22D 39/00; D01D 5/08
See application file for complete search history.

(56) References Cited

U.S. PATENT DOCUMENTS 2,910,744 A * 11/1959 Pond ..... B22D 11/005 164/272
3,216,076 A * 11/1965 Alber ..... B22D 11/005 164/423
(Continued)

FOREIGN PATENT DOCUMENTS

EP 3141320 A1 3/2017
JP 54130416 A 10/1979
(Continued)

OTHER PUBLICATIONS

Chen, H. S. and Miller, C. E.: "Centrifugal Spinning of Metallic Glass Filaments".
(Continued)

*Primary Examiner* — Scott R Kastler
(74) *Attorney, Agent, or Firm* — Dickinson Wright PLLC

(57) ABSTRACT

The invention relates to a method of producing elongate metal strands or fibres with a crucible, the method comprising the steps of; directing molten metal through a nozzle having a nozzle direction in a deposition direction at a regulated pressure difference between the inside and the outside of the crucible; depositing said molten metal from said nozzle on a rotating planar surface having an axis of rotation; entraining said molten metal in one plane via said rotating planar surface to form elongate metal strands, wherein said rotating surface is aligned at an alignment angle, to the deposition direction during the entraining of the molten metal; cooling said elongate metal strands to form solidified metal strands; and guiding said metal strands to
(Continued)

collecting means to collect the solidified metal strands formed on the rotating planar surface.

29 Claims, 11 Drawing Sheets

(51) Int. Cl.

| | |
|---|---|
| ***B22F 1/062*** | (2022.01) |
| ***B22F 3/00*** | (2021.01) |
| ***B22F 9/08*** | (2006.01) |
| ***B22F 9/10*** | (2006.01) |
| ***D01D 5/08*** | (2006.01) |

(52) U.S. Cl.
CPC ..... *B22F 1/062* (2022.01); *B22F 3/002* (2013.01); *B22F 9/10* (2013.01); *B22F 2009/088* (2013.01); *B22F 2998/10* (2013.01); *D01D 5/08* (2013.01)

(56) References Cited

U.S. PATENT DOCUMENTS

| | | | | |
|---|---|---|---|---|
| 3,713,477 | A * | 1/1973 | Kuniyasu ..... | B22D 11/005 164/460 |
| 4,863,509 | A | 9/1989 | Metz | |
| 2022/0212252 | A1 * | 7/2022 | Spatz ..... | B22D 23/003 |

FOREIGN PATENT DOCUMENTS

| | | | |
|---|---|---|---|
| JP | 55031436 | A | 3/1980 |
| JP | 2001172704 | A | 6/2001 |
| JP | 2018516177 | A | 6/2018 |
| WO | 2011095141 | A1 | 8/2011 |

OTHER PUBLICATIONS

Shirzadi, A. A. et al.: "Developments of Auto Ejection Melt Spinning (AEMS) and its application in fabrication of cobalt-based ribbons".

Zhang, Xiangwu and Lu, Yao: "Centrifugal Spinning: An Alternative Approach to Fabricate Nanofibers at High Speed and Low Cost".

International Search Report for related International Application No. PCT/EP2020/063026; dated Jul. 7, 2020; 13 pages.

Written Opinion for related International Application No. PCT/EP2020/063026; dated Jul. 7, 2020; 13 pages.

Office Action issued for corresponding Japanese Patent Application No. 2021-563688 mailed on Jan. 15, 2024, along with English translation.

* cited by examiner

Figure 9:
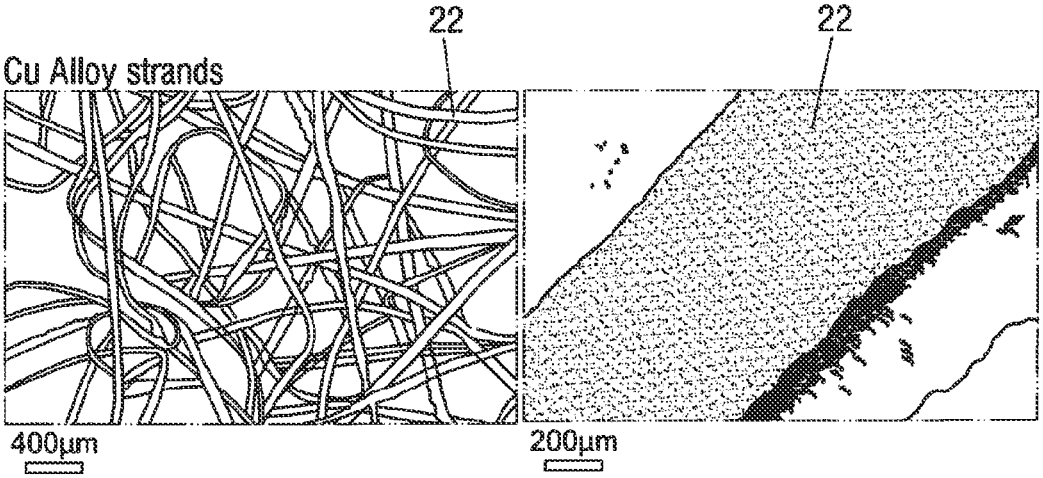
Figure 10:
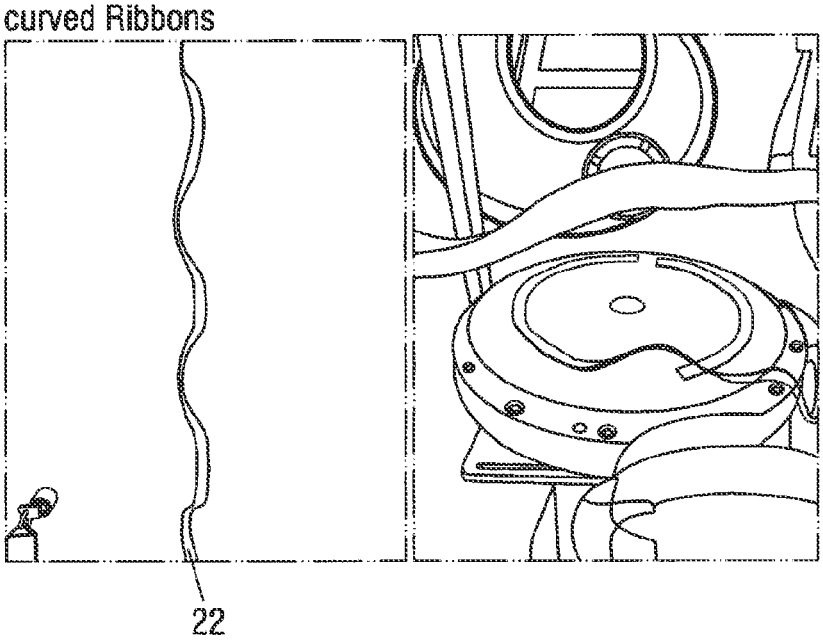

Figure 9: Al - Alloy strands

METHOD OF PRODUCING METAL STRANDS AND APPARATUS FOR PRODUCING METAL STRANDS

CROSS-REFERENCES TO RELATED APPLICATIONS

This application is a 371 National Phase Application of PCT Application No. PCT/EP2020/063026, filed on May 11, 2020, which claims the priority of both European Application No. 19173835.0, filed on May 10, 2019 and of European Application No. 19175749.1, filed May 21, 2019, each of which is incorporated herein by reference in their entirety.

The present invention relates to a method of producing elongate metal strands and/or fibres, to an apparatus for producing elongate metal strands and/or fibres and to a metal fibre obtainable by a method according to the invention and/or by using an apparatus according to the invention.

A known method to produce metal strands is the process of melt spinning. Melt spinning is a technique used for rapid cooling of metal liquids. A thin stream of metal liquid is then dripped onto the circumferential surface of a fast rotating wheel where it undergoes rapid solidification. This technique is used to develop materials that require extremely high cooling rates in order to form elongated strands of materials such as metals or metallic glasses. The cooling rates achievable by melt-spinning are of the order of $10^4$-$10^7$ Kelvin per second (K/s). The process can continuously produce thin ribbons of material.

In this connection it should be noted that a strand can be understood as an element of which the length is at least twice its width, while the geometry of its cross section may be round, oval, quadratic or triangular.

A special role is assigned to metal strands and/or fibers with a lateral dimension in the micrometer range, i.e. 1 to 50 micrometers, and a length of several millimeters or centimeters. These materials, as individual fibers, mesh of fibers or bunch of fibers, also in combination with other materials play a central role in a whole series of applications for the improvement of the most diverse properties. Examples of such are metallic wool and tissues, 3-dimensional electrodes for batteries and accumulators, catalysis, conductive plastics for touch sensitive systems such as displays and artificial hands in the field of robots, anti-electrostatic textile and plastics, mechanically reinforced textiles, plastics and cement for lightweight and heavy construction, filter materials for use in environments subjected to mechanical and/or chemical stress or catalysis.

An important aspect for the improvement of metal strand based material functions is a large surface area to weight ratio and the ability to manufacture and process such strands in an industrially relevant process. This signifies: adjustable lengths, widths and cross section geometries of metal strands, reproducibility and economic manufacturing methods and low process costs with a high material yield per unit time.

Nowadays, the industrially relevant manufacture of functional materials based on metal strands is restricted to strand width of about 50 μm and larger. These methods are based on drawing, template, rolling or extrusion processes. Fibers of stainless steel with a width down to 8 micrometers are manufactured by a complicated drawing process starting from a bundle of larger diameter fibers which are drawn to smaller diameters. In order to allow gliding of the fibers along each other the fibers need to be coated with a layer of copper for example. These methods however have disadvantages when being utilized industrially because they are restricted to a few materials only, long process times and costly fabrication- and postfabrication processes.

Conventionally known apparatuses for producing metal strands via a melt-spinning process usually let molten metal flow on a circumferential surface of a rotating wheel. This allows the metal melt to coat partly the rotating circumferential surface of the wheel with a certain thickness and to being "thrown off" the wheel as straight strand of defined thickness due to centrifugal forces originating from the rotation of the wheel once the metal is solidified.

Usually, the practicability of such machines is complex and not very industrial friendly. The circumferential surface of the wheel is easily damaged during the process and replacement or polishing of the wheel is time and cost consuming. As a result of the rotating wheel the centrifugal forces point perpendicular away from the circumferential surface which reduces the wetting capability of the metal melt on the rotating wheel and as such limits the reduction of the thickness of the metal strands. The direction of the centrifugal forces and the curvature of the circumferential surface causes quick removal of the strands from the circumferential surface once they are solidified. Therefore, cooling of the solidified metal strands is limited and the still hot metal pieces remove material from the wheel which damages the wheel.

Eventually, the mechanical precision of traditional melt spinners is altered since the bearing which holds the rotation axis of the heavy wheel faces constant momentum due to the weight of the wheel which is balanced by the bearing. This makes the wheel to rotate with reduced precision instead of a wheel which would not cause any momentum.

It is an object of the invention to provide a method and an apparatus for producing metal strands and fibres with any desired thickness, width or length in a reproducible manner.

In order to satisfy this object there is provided, in accordance with the present invention, a method for producing elongate metal strands and/or fibers with a crucible, the method comprising the steps of: directing molten metal through a nozzle having a nozzle direction in a deposition direction at a regulated pressure difference between the inside and the outside of the crucible, depositing said molten metal from said nozzle on a rotating planar surface having an axis of rotation, entraining said molten metal in one plane via said rotating planar surface to form elongate metal strands, wherein said rotating planar surface is aligned at an alignment angle with respect to the deposition direction during the entraining of the molten metal, cooling said elongate metal strands to form solidified metal strands, and guiding said metal strands to collecting means to collect the solidified metal strands formed on the rotating planar surface. In other words, molten metal is dripped or poured on a planar surface, while the surface is rotating. Because of the movement of the surface, the metal drop or stream is entrained and hence is elongated to a strand. While still being on the rotating planar surface and moving with it, the molten metal strand can cool down at least to the point where it solidifies to a metal strand. At a given point after the solidification the metal strand gets "thrown-off" the surface due to the rotation of the surface, for example because of centrifugal forces, and can be collected by collecting means.

By using planar surfaces which are aligned at an alignment angle with respect to the deposition direction instead of for example circumferential surfaces, the time the metal can take to cool down and solidify can be increased substantially. Namely, the molten metal has longer contact times with the planar surface and can therefore cool down to lower temperatures before leaving the surface again. This also leads to the possibility of forming metal strands of greater length to width ratio as was previously possible. Moreover, this also leads to less damage of the surface since the metal can solidify properly before leaving the surface.

The invention described here permits the manufacturing of metal strands having any desired thickness, also thicknesses significantly less than 10 micrometer, and an aspect ratio of length to width starting from 2:1 up to greater than 1000:1.

According to a first embodiment of the invention the rotating planar surface is arranged, in particular at least approximately, perpendicular to the deposition direction during said steps of entraining and cooling said molten metal. This does not necessarily mean that the planar surface is not perpendicular to the deposition direction during the other steps of the method, but it means that at least during the step of entraining the molten metal the planar surface has to move in a direction perpendicular to the deposition direction in this embodiment. The planar surface can hence for example be designed as planar surface, which rotates in a plane perpendicular to the deposition direction at all times during all steps of the method. The rotating planar surface may be of circular, oval, quadratic or rectangular geometry while its lateral dimensions may range from 1 to 5000 cm, in particular between 10 and 400 cm or 250 cm or 350 cm.

According to a second embodiment of the invention the alignment angle of the rotating planar surface is selected to lie in the range of 90° to 1° with respect to the deposition direction and/or the nozzle direction is selected to lie in the range of 0° to 90° with respect to the rotating planar surface. Hence, the rotating planar surface can for example be aligned perpendicular to the deposition direction of the nozzle, wherein the nozzle itself can be aligned at a nozzle direction which is different from 90° with respect to the planar surface. Thus, it can be chosen as necessary with which angle alignment the rotating planar surface and the nozzle as well as its deposition direction are arranged to each other.

According to another embodiment of the invention the moving surface is a base interface of a rotating wheel. This means that the wheel is simply aligned with its base interface facing the nozzle.

Thus, the rotating planar surface rotates around an axis of rotation. When letting the surface rotate around an axis, centrifugal forces can arise. These centrifugal forces can be used in order to "throw" the solidified metal strands off the moving surface in order to guide them for example to the collecting means. In such a case no further apparatuses for picking up the solidified metal strands are needed other than e.g. a collector.

A spacing between the nozzle opening and the rotating planar surface may be at least 10 μm and is typically selected in the range of 10 μm to 20 mm, especially of 50, 100 or 200 μm. In this way one can ensure that the molten metal is generally incident perpendicular on the rotating planar surface irrespective of the alignment angle, i.e. the nozzle direction relative to the rotating planar surface. One can also ensure that the molten metal is deposited in the form of drops or as a continuous flow of molten metal onto the rotating planar surface.

The axis of rotation is preferably perpendicular to the rotating planar surface when the rotating planar surface is designed as a base interface of a rotating wheel. Therefore, if the rotating planar surface can rotate for example around an axis of rotation, which is parallel to the deposition direction, e.g. as an axial surface of a wheel rather than the circumferential surface of a wheel as is known in the prior art, the rotating planar surface can be arranged perpendicular to the deposition direction at all times during the method.

It is another embodiment of the invention that a deposition position of the nozzle relative to the rotating planar surface is adjusted relative to the rotating planar surface, for example parallel to and preferably also perpendicular to the rotating planar surface. As an example, if the rotating planar surface is chosen to be a rotating disc, the position of the nozzle can be adjusted radially in order for the user to decide at which point of the disc's radius the molten metal should be deposited. A drop of molten metal, which is deposited nearer to the centre of the disc, experiences a smaller acceleration than a drop, which is deposited farther on the outside of the disc. It is therefore an advantage to be able to decide at which exact point the molten metal should be deposited on the rotating planar surface, since one can hence decide, at which acceleration the molten metal is deposited on the rotating disc and the amount of time during which the metal gets to travel together with the rotating planar surface.

According to another embodiment, the rotating planar surface is cooled, preferably to a temperature lying in the range of 0 to 50° C., especially to room temperature. The rotating planar surface needs to be cooled since the surface is almost constantly in touch with molten, and hence hot, metal and would therefore heat up quite fast. A heated surface would hinder the molten metal to cool down and solidify, which would be contrary to what it should do. Furthermore, with an actively cooled planar surface surface the gradient of cooling of the molten metal can be controlled and hence reproducible results for the solidified metal strands can be expected.

According to a second aspect of the invention an apparatus for producing elongate metal strands and/or fibres is provided, preferably configured to use the method according to the invention, wherein the apparatus comprises a rotating planar surface, at least one nozzle in a nozzle direction having a nozzle opening for directing molten metal in a deposition direction onto the rotating planar surface, the rotating planar surface being configured to move under an alignment angle, preferably perpendicular, with respect to said deposition direction to entrain and cool the molten metal in one plane via said movement of the rotating planar surface to form solidified elongate metal strands at said rotating planar surface, and collecting means configured to collect the solidified strands of metal formed on the rotating planar surface and separated from the rotating planar surface by force generated by the movement of the rotating planar surface. The nozzle opening of the nozzle can be chosen such that either metal strands of different widths can be produced, i. e. in the range of 1 μm to 5 cm. There is no limitation to the dimensions and/or geometry of the nozzle opening in order to be able to produce strands and fibres of different sizes and widths.

It is an embodiment of the invention that the apparatus comprises a rotatable wheel. The wheel can have planar surfaces which can move perpendicular to the deposition direction, i.e. the radial surface of said wheel can be used as the planar surface.

According to another embodiment of the invention the rotating planar surface is aligned perpendicular to the deposition direction during the entraining of the molten metal. The phase of the production during which the entraining—and therefore also the cooling—of the molten metal takes place, is the crucial part of the melt spinning process. The longer the molten metal can stay on the rotating planar surface, the lower its temperature can get and the better it can solidify before being guided to the collecting means. A planar surface, which is aligned perpendicular to the deposition direction can increase the time during which the molten metal is entrained and cooled substantially compared to known prior art, which often uses the circumferential surface of a wheel as the contact surface.

According another embodiment of the invention the rotating planar surface is aligned at an alignment angle with respect to the deposition direction during the entraining of the molten metal, wherein the alignment angle is selected to lie in the range of 90° to 1° and/or the nozzle direction is selected to lie in the range of 0° to 90° with respect to the rotating planar surface.

It is another embodiment of the invention that the rotating planar surface rotates around an axis of rotation, which is aligned perpendicular to the rotating planar surface. Therefore, the rotating planar surface can be implemented as a disc, a wheel or any other surface which can be moved e.g. in a rotating manner, while being planar at least at a certain time during its rotation.

An advantage of a wheel or disc, which rotates around an axis of rotation which is parallel to the deposition direction is also that a vertical bearing of the wheel has proven to be more stable compared to a horizontal bearing. Hence, the rotation of the disk or the wheel is smoother.

According to another embodiment the rotating planar surface comprises at least one exchangeable plate. Since the planar surface is often in contact with molten and hence hot metal, it will experience wear over time. An exchangeable plate has proven to be extremely useful when the wear of the surface reaches a point which cannot be tolerated anymore. This way, only the plate can be exchanged or machined in case of wear and not the whole device, i. e. for example the whole wheel, to which the rotating planar surface is attached. Another potential application of the plate is the use of different types of plates, e.g. made from different materials or the altering of the surface structure of the rotating planar surface depending on the type of metal to be molten. The plate can be chosen according to the desired result.

In this connection a set of exchangeable plates may hence be provided with each plate of the set of exchangeable plates being made from the same material as the remaining plates of the set of exchangeable plates, or wherein a variety of plates made from different materials is provided in the set of exchangeable plates.

According to an embodiment a deposition position of the nozzle is adjustable at least parallel to the rotating planar surface. As it has already been described earlier, one of the crucial parts of the melt spinning process is the amount of time during which the molten metal stays on the surface. The longer the metal can stay on the surface, the longer it can cool down and solidify. Depending for example on the type of metal which is to be molten or the dimensions of the strands or fibres which are produced, the cool down time can vary. With an adjustable nozzle one can choose on which exact point on the planar surface the metal is deposited and hence, how long it can stay on said surface before it is guided to the collecting means due to for example centrifugal forces.

According to another embodiment the nozzle opening is of any geometry, especially rectangular, circular, oval, quadratic or triangular, and is aligned in any direction with respect to the rotating planar surface. Depending on how large the width, thickness and length of the metal strand should be, the size and dimensions of the nozzle opening can be chosen appropriately. The width of the nozzle for example can even be chosen to be smaller than 100 μm in order to produce micrometer wide strands. The width of the nozzle opening can be selected to lie in the range from 10 μm to 10 mm. Hence, the width of the nozzle opening can be selected according to the desired width of the metal strand or fibre. For the production of metal fibres a width selected from a range of 10 to 500 μm is preferred, whereas for the production of metal strands a width selected in a range of 500 μm to 10 mm is preferred.

It is another embodiment of the invention that the apparatus comprises at least two nozzles, preferably between 4 and 12 nozzles, in particular 8 nozzles, each nozzle having a nozzle opening for directing molten metal in onto the rotating planar surface of the moving means, wherein each nozzle is adjustable at least parallel to the rotating planar surface. An example for such an embodiment can be an apparatus with 8 nozzles which deposit molten metal on the radial surface, in particular on a plate, of a rotating wheel. The nozzles can be arranged evenly or non-evenly around the circumference of said radial surface in order to produce eight strands of metal at the same time. This leads to a more efficient apparatus compared to known apparatuses since more than one fibre or strand can be produced at the same time with one apparatus only. The number of nozzles can be chosen as needed.

The wheel is furthermore conveniently mounted to rotate within a chamber having an atmosphere at a lower pressure than ambient pressure. The atmosphere in the chamber affects the formation of the solidified metal strands and can be used to fine tune the geometry of the metal strands that are produced. For metals which react with the constituents of air it can be favorable to use an inert gas atmosphere in the chamber. Also, under some circumstances a reactive gas atmosphere could be beneficial, for example a nitrogen or carbon containing atmosphere could be used to nitride or carburize suitable steel materials if hardened metal strands are desired. A deflector such as a scraper blade or doctor blade can optionally be provided upstream of the nozzle in the direction of rotation of the wheel to deflect boundary air from the moving surface prior to depositing molten metal on the surface via the nozzle. Such a deflector, which only needs to have a minimum spacing from the moving surface to avoid damaging the structure thereof (and the function of which can also be provided by the nozzle if this is positioned close to the moving surface), can prevent the boundary air carried along with the moving surface from undesirably affecting the flow of molten metal from the nozzle onto the rotating planar surface, for example thereby reducing cooling of the metal material prior to it reaching the surface.

Generally speaking a gas pressure is applied to the molten metal to force it through the nozzle. Such a gas pressure is generally necessary because the high surface tension/energy of the molten metal will inhibit its flow through a small nozzle. The additional gas pressure (additional to the weight of the molten metal) causes the molten metal to flow through the nozzle. When reference is made here to the pressure applied to the molten metal the pressures recited will be understood to be the amount by which the pressure is higher than the pressure prevailing in the chamber of the apparatus, which is frequently kept below atmospheric pressure, e.g. at 400 mbar.

The gas pressure is typically selected in the range from 50 mbar to 1 bar overpressure relative to the pressure external to the nozzle. The gas pressure regulates the deposition rate of molten metal onto the rotating planar surface. This parameter controls the dimension of the metal ribbon as well.

Preferably the metal is one of copper, a copper alloy comprising silicon, aluminium, aluminium alloy comprising silicon, an iron, an iron alloy and FeNiB.

Figure 1:
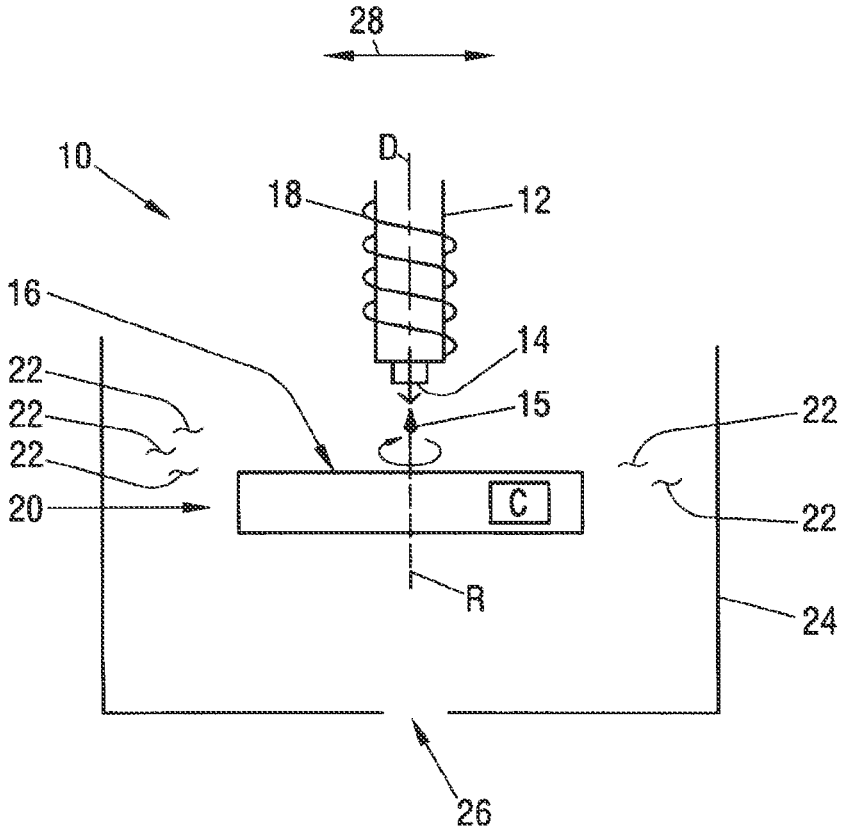
Figure 2:
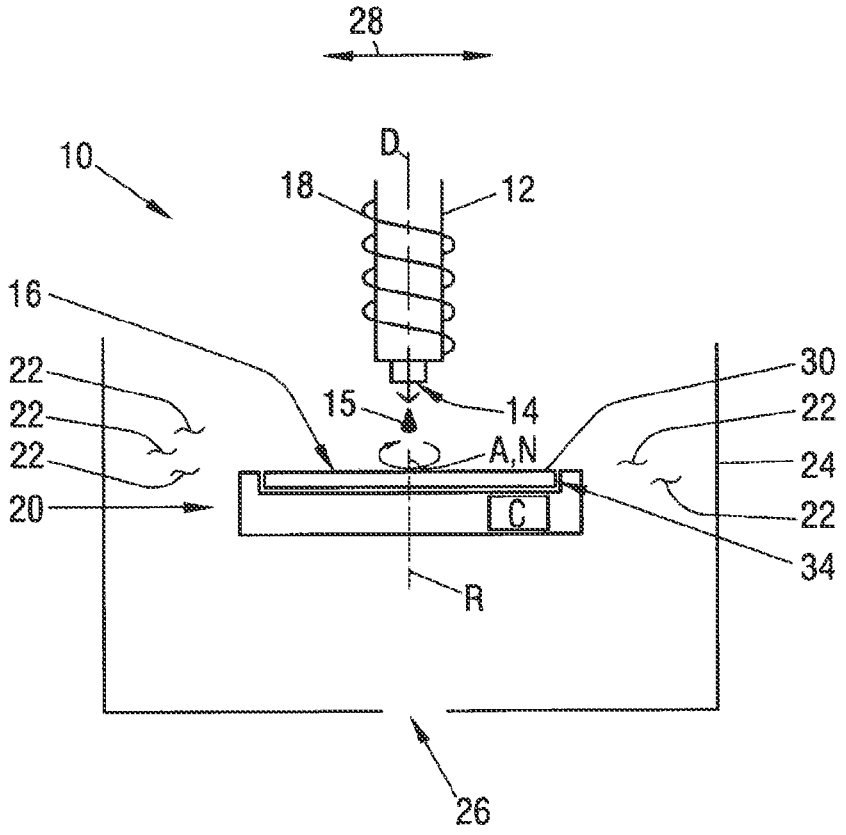
Figure 3:
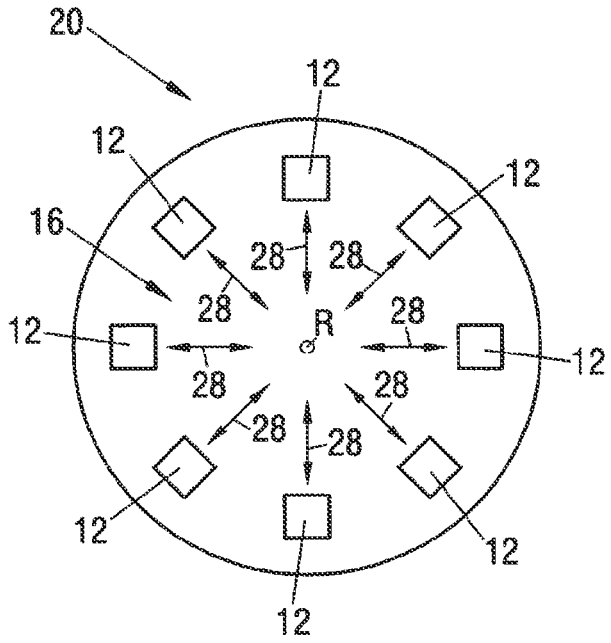
Figure 4A:
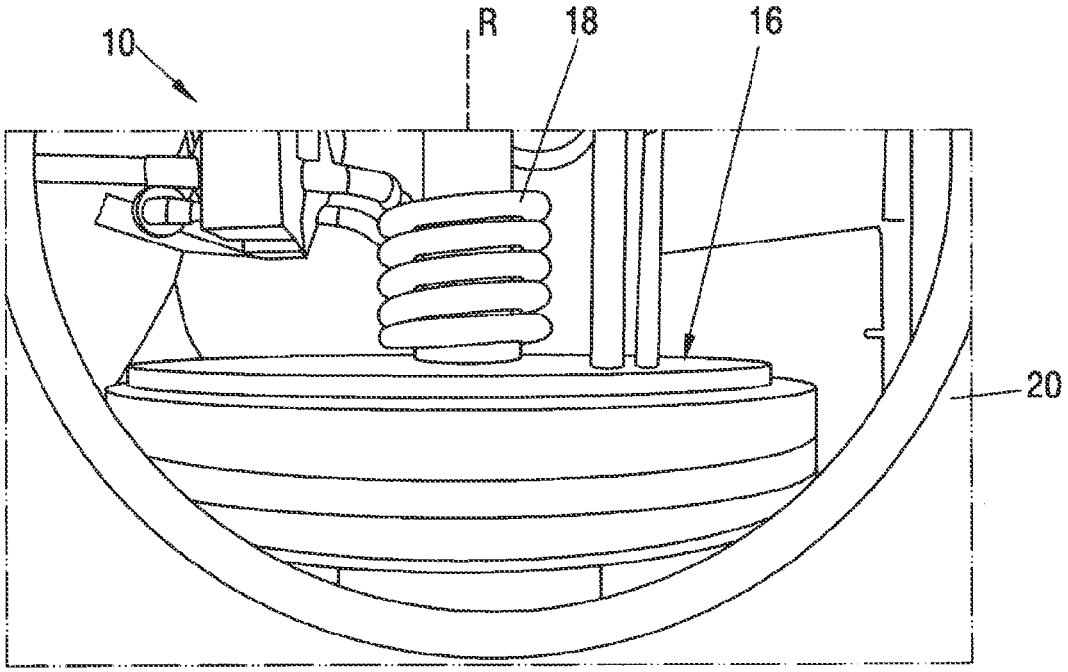
Figure 11:
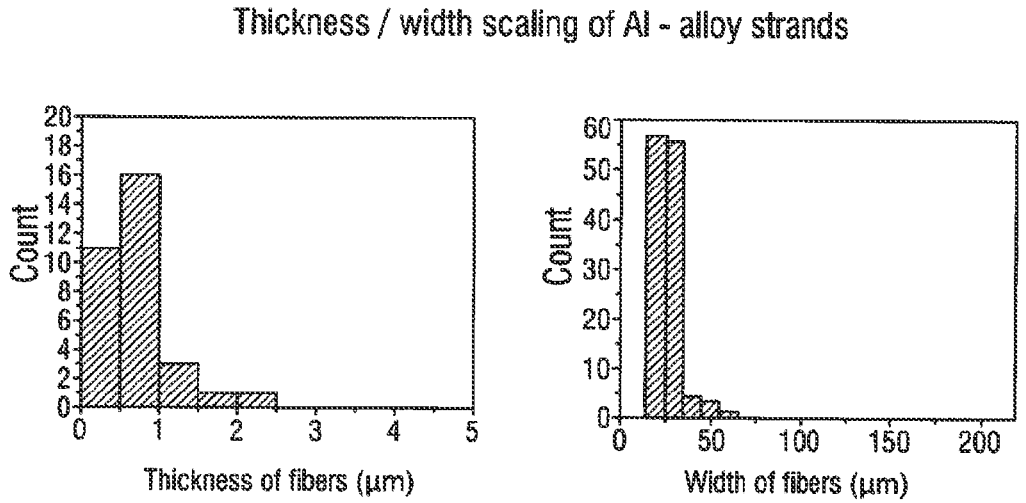
Figure 12:
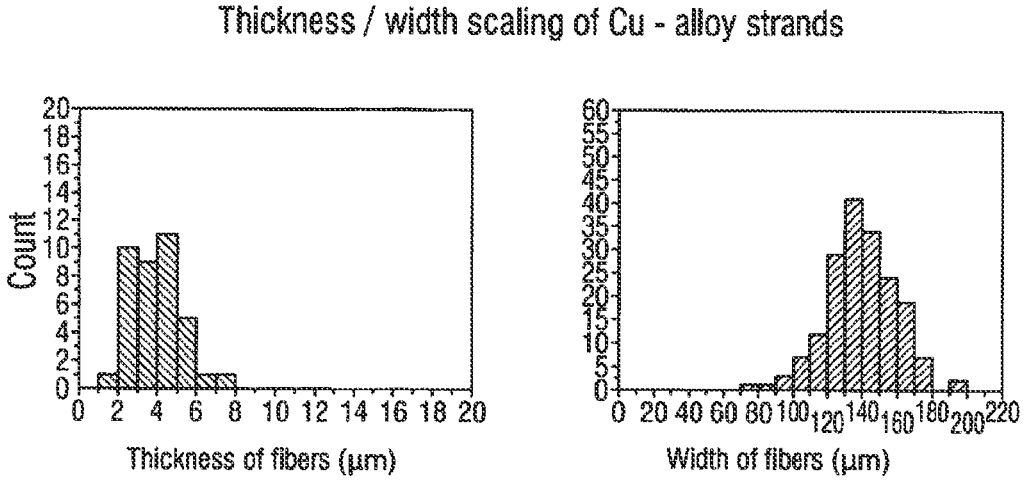

The invention will now be described in further detail by way of example only with reference to the accompanying drawings. In the drawings there are shown:

FIG. 1: a first embodiment of an apparatus according to the invention;

FIG. 2: a second embodiment of an apparatus according to the invention;

FIG. 3: a top view of an exemplary embodiment with a plurality of nozzles;

FIG. 4*a*: an example of a real life apparatus according to the invention;

FIGS. 4*b* to 10: different examples of metal strands and fibers, which are produced with an apparatus according to the invention; and FIG. 11 to 12: different distributions of the strand thicknesses produced with an apparatus according to the invention.

FIG. 1 shows a first embodiment of an apparatus 10 for producing elongate metal strands, in particular a melt spinning apparatus, comprising a nozzle 12 with a nozzle opening 14 which deposits drops or streams of molten metal 15 in a deposition direction (see arrow D) onto a rotating planar surface 16. In order to be able to deposit molten metal, the nozzle 12 comprises a heating device 18 which heats the metal inside the nozzle 12 to a temperature where the metal is in its liquid state.

The nozzle opening 14 may be of any geometry, usually circular, oval, rectangular, quadratic or triangular. The opening width can lie in the range of 10 μto 10 mm, depending on the size of the metal strand 22 or fiber 22 that should be produced. In the case of metal strand 22 production, the width of the nozzle opening 14 is usually chosen from a range of 500 μm to 10 mm, whereas in the case of fiber 22 production the width of the nozzle opening 14 is chosen from a range of 10 μm to 500 μm. Hence, different nozzle opening 14 sizes are possible depending on the desired application of the apparatus 10. The nozzle direction N may vary from 90° with respect to the planar surface 16, i. e. it may be selected to lie in the range from 90° to 0°. Hence, the nozzle 12 could also be aligned parallel to the rotating planar surface 16 and still have a deposition direction D which is perpendicular, or any other angle, to the planar surface 16.

The planar surface 16 is located on a wheel 20 which rotates around its axis of rotation R, which is aligned parallel to the deposition direction D. Hence, the planar surface 16 is designed to be the radial surface of the wheel 20. It is noted that the wheel 20 can rotate clockwise as well as counterclockwise. Furthermore, it is noted that the planar surface 16 could also be aligned at an alignment angle A with respect to the deposition direction D, wherein the alignment angle A can be selected to lie in the range of 0 to 90°. Additionally, the surface 16 may also comprise an oval, rectangular or quadratic shape.

The diameter of the wheel can range from centimeter to meters and the wheel material maybe of any choice which withstands the metal molt deposition and fast rotation speed, in particular metal alloys such as copper, copper alloys, brass, nickel, iron, ironoxide, stainless steel or carbon based material such as graphite or carbide, ceramic materials. It is also possible that the wheel 20 is a wheel of a base material having a layer made of a metal or of a metal alloy of a ceramic material or of graphite or a vapor deposited carbon, for example a copper wheel 20 having a layer of graphite.

Because of the rotation of the wheel 20, the molten metal drops or streams 15, which come into contact with the surface 16 are entrained and thereby elongated by the wheel 20 to form elongate metal strands 22. These strands 22 remain on the surface 16 until they are cooled down enough to solidify. For this purpose the rotating wheel 20 can be cooled by a cooling device C to for example room temperature or even below by cooling with liquid nitrogen in order for the molten metal drops 15 to be able to solidify to metal strands 22. If the wheel was not cooled at all it would eventually heat up because of its contact with the (hot) molten metal 16 and hence prevent the molten metal 16 to cool down sufficiently to solidify. Heating of the wheel can also affect its mechanical stability. The cooling device C is shown inside the rotatable wheel 20, but it is noted that does not necessarily have to be located inside the wheel. There are sufficiently many methods known to cool such devices.

Once the metal strands 22 are solidified the centrifugal forces which act on the metal strands 22 due to the rotation of the wheel 20 will suffice in order to move the metal strands 22 away from the planar surface 16. As the adhesion force between the solidified metal strand 22 and the planar surface 16 is less than a force acting on the metal strand 22 due to the rotation of the planar surface 16. Thus, the solidified metal strands 22 fly away from the wheel 20 in a direction transverse to the circumference of the wheel 20.

That is why a collector 24 is arranged in such a way to intercept the solidified metal strands 22 and guide them to an opening 26 at the bottom of the collector 24 in order to collect the produced metal strands 22. Guiding of solidified metal strands may also be possible by a flow of gas inside the melt spinning chamber.

Turbulences may affect the collections of metal strands especially in case of small fibers. This may be prevented by positioning a strong flow of gas or a solid wall which guides the fibers or by evacuating the chamber that no turbulences may occur.

Depending for example on which type of metal is to be molten, the cooling times can differentiate substantially. That is also why the nozzle is adjustable at least parallel to the planar surface (see arrow 28). When using a rotatable wheel 20 it makes sense to use a nozzle which is adjustable in a radial direction of the wheel 20 in order to decide how dose to the center of the wheel the molten metal 15 should be deposited. Depending on the deposition position, the molten metal undergoes a different acceleration. For some applications the nozzle 12 can also be adjustable in a direction perpendicular to the planar surface 16.

Although a diameter of the wheel 20 of 20 cm to 55 cm is preferred this is not critical and wheel 20 diameters in the range from 1 to 100 cm can be used. A larger diameter of the planar surface 16 of the rotating wheel 20 increases the circumferential speed of the wheel 20 for outer tracks if the speed of rotation is kept constant and the position of the nozzle 12 relative to the axis of the wheel 20 is changed. Thus a larger diameter of the wheel 20 can result in a smaller width of and shorter length of the metal strands or fibers 22 at constant speed of rotation.

A controller (not shown) can be provided for maintaining the speed of rotation of the wheel 20 constant so that the surface speed of the planar surface 16 lies in the range between 10 to 100 m/s, especially between 30 and 80 m/s, ideally between 40 to 60 m/s at the circumference of the wheel 20 with a wheel 20 of 20 cm or lager diameter of the external circumference.

The production of fiber material and metal strands is a combination of the material flow from the nozzle 12 and the speed of rotation of the rotatable wheel 20. If one succeeds in drastically reducing the metal flow from the nozzle 12 then it is also possible to operate with lower speeds of rotation. Accordingly, a speed of rotation of 10 Hz with a wheel 20 of 200 mm diameter is also entirely possible provided the amount of molten material 15 discharged from the nozzle 12 is correspondingly reduced.

FIG. 2 shows an embodiment of the apparatus according to the invention which mostly corresponds to that of FIG. 1. The only difference between the two embodiments lies in the fact that the rotatable wheel 20 comprises a plate 30, which consequently comprises the planar surface 16. The plate 30 is exchangeable and can thus be easily replaced once the planar surface 16 has worn off too much or if a different material or surface structure of the planar surface 16 is desired. Thus, the versatility of the wheel 20 is enhanced substantially.

Different plates 30 can also comprise different structures such as grooves or can be made out of different materials. Hence, a plate 30 can be chosen according to the type of metal to be molten and/or according to the type of strand or fibre to be produced.

Hence, the plate 30 or the plurality of plates 30 can be made out of the same materials as the wheel 20 of FIG. 1. Also the layering of different materials is possible in order to have different plates 30 for different applications or different types of metal to be used for the production of the strands or fibers 22.

In order to place the plate 30 onto the wheel 20, the wheel 20 comprises a recess 34 in which the plate 30 is arranged. In the case of a rotating wheel 20 like in FIG. 3 the plate can be designed as a circular disc, a ring, a ring-segment or a circular segment. Hence, one wheel 20 can comprise one or more plates 30 at the same time.

The dimensions of the recess 34 depend on the dimensions of the plate (or plates) 30, which are used, i. e. the recess 34 can either have the form of a ring or of a circle. Accordingly, the recess 34 for the corresponding plate 30 (or plates 30) can have a diameter which is almost the same as the diameter of the wheel 20 itself, i.e. preferably between 20 and 35 cm. The exact dimensions for a recess 34 in the form of a ring depend on the dimensions of the plate 30. The inner radius of such a ring lies in the range of 1 to 30 cm, whereas the range of the outer radius of such a ring lies in the range of 5 to 35 cm—always depending on the actual size of the wheel 20. This means that for a wheel of 200 cm diameter, the outer diameter of the plate may be up to 198 cm, and the inner diameter of the ring shaped plate may be as little as 5 cm. The recess 34 material can be different from the plate 30 material, i. e. the recess 34 material may be a mechanically very strong material such as Tungsten while the plate 30 material may be weaker like copper, such that the recess stabilizes the plate mechanically. This would allow the wheel 20 to rotate at speeds where the recess 34 is still stable but the inner plate 30 would be destroyed because of centrifugal forces.

In the case of a plurality of plates 30 for one wheel 20 it can be preferred that all of the plates 30, which are in use at the same time, are made out of the same material. Hence, with the use of a plurality of identical plates 30 the apparatus 10 gets way more versatile in its handling, because the single plates 30, which together form the planar surface 16, can be exchanged separately in the case of wear or when a different type of metal is used for the production or when different kinds of fibres are produced.

FIG. 3 shows a top view of another embodiment of the invention where one rotatable wheel 20 is provided together with nozzles 12 which are radially adjustable along the respective arrows 28. With such an arrangement eight metal strands can be produced at the same time. This makes the apparatus much more efficient compared to known apparatuses from the state of the art.

In principle every angle of arc for arrangement of the nozzles 12 is possible around the circumference of the moving surface 16. It has proven to be an advantage when the nozzles 12 are arranged evenly around the circumference of the wheel 20. Hence, possible angles for the arrangement of the for example eight nozzles 12 shown in FIG. 4 are 0°, 45°, 90°, 135°, 180°, 225°, 270° and 315°.

Also other angles like 30°, 60°, 120°, 150°, 210°, 240°, 300° and 330° are possible, if there are for example twelve nozzles 12 present. Hence, one can see that since the wheel 20 is rotating around its axis of rotation R, the exact angles for the placement of the nozzles 12 can be chosen as desired as long as the nozzles 12 are arranged evenly around the circumference of the moving surface 16.

FIG. 4*a* shows a photograph of an example of a real life apparatus 10 with a wheel 20, which is aligned horizontally to the ground, i. e. its axis of rotation R is aligned parallel to the deposition direction D of the molten metal. FIG. 4*a* shows an example of a real life application of the apparatus 10 described in connection with FIGS. 1 and 2.

FIGS. 4*b* to 10 show different examples of metal strands and fibers 22, which were produced with an apparatus 10 according to FIG. 1.

Figure 4B:
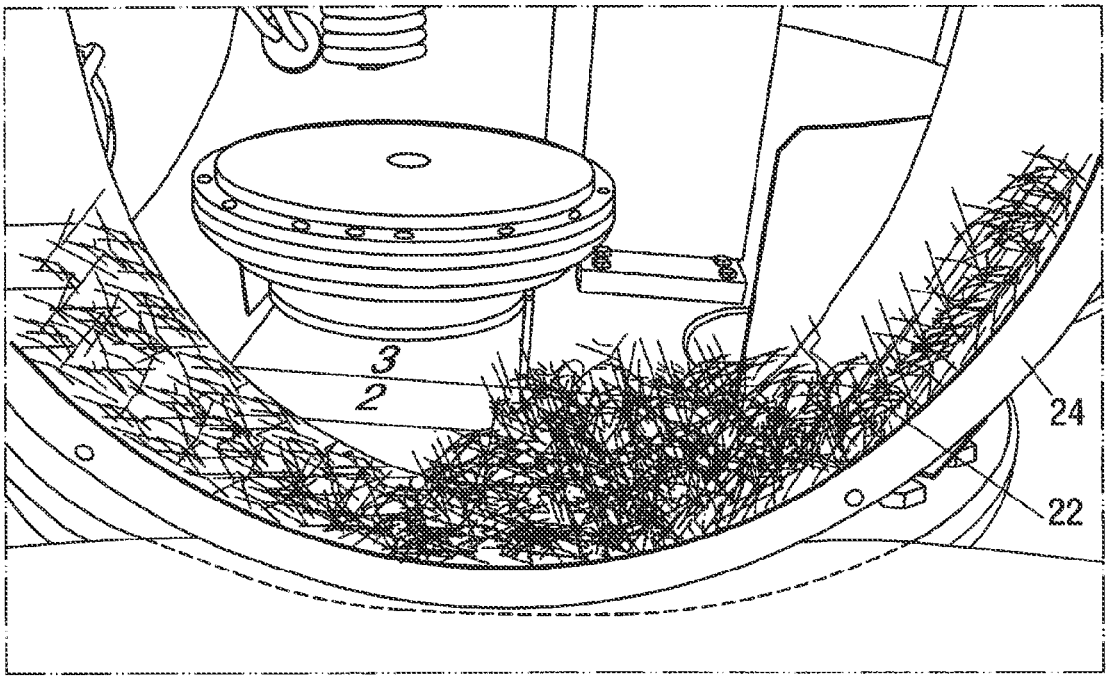
Figure 4B:
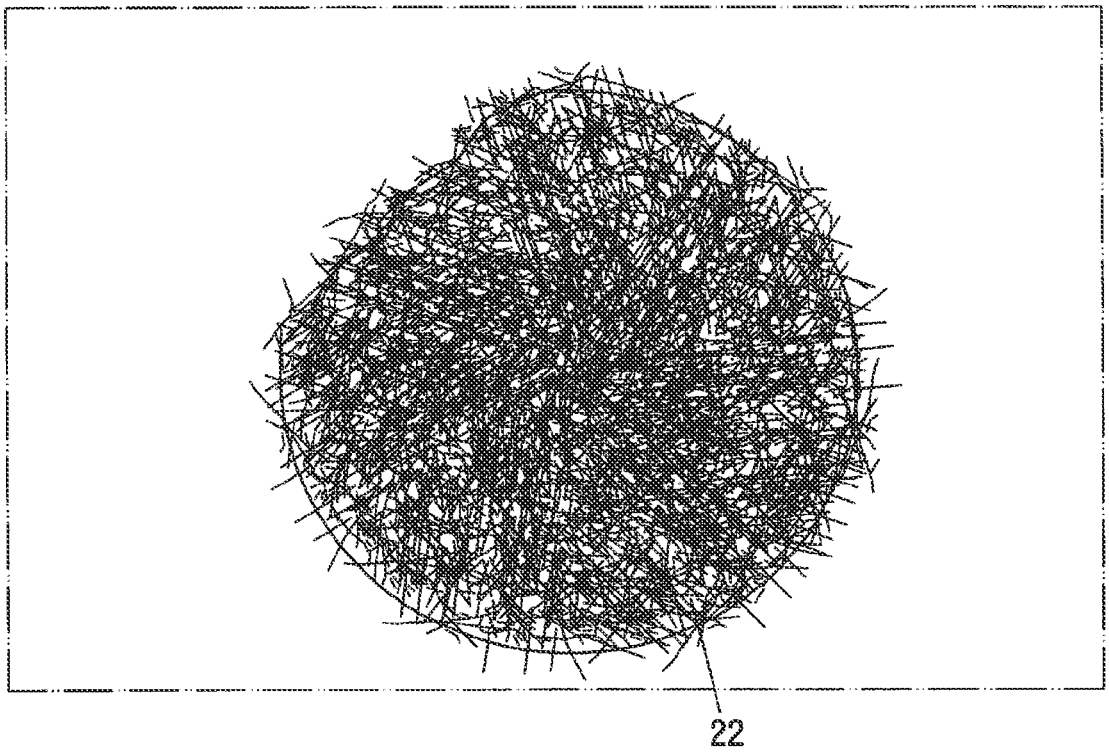

FIG. 4*b* shows two pictures made of fabricated metal fibers 22 inside a collector 24. One can see that the produced fibers 22 are directed in the direction of the opening 26 where they can be collected by an operator or by a (not shown) container. About 90% of the produced fibers 22 could be collected with the collector 24.

Figure 5:
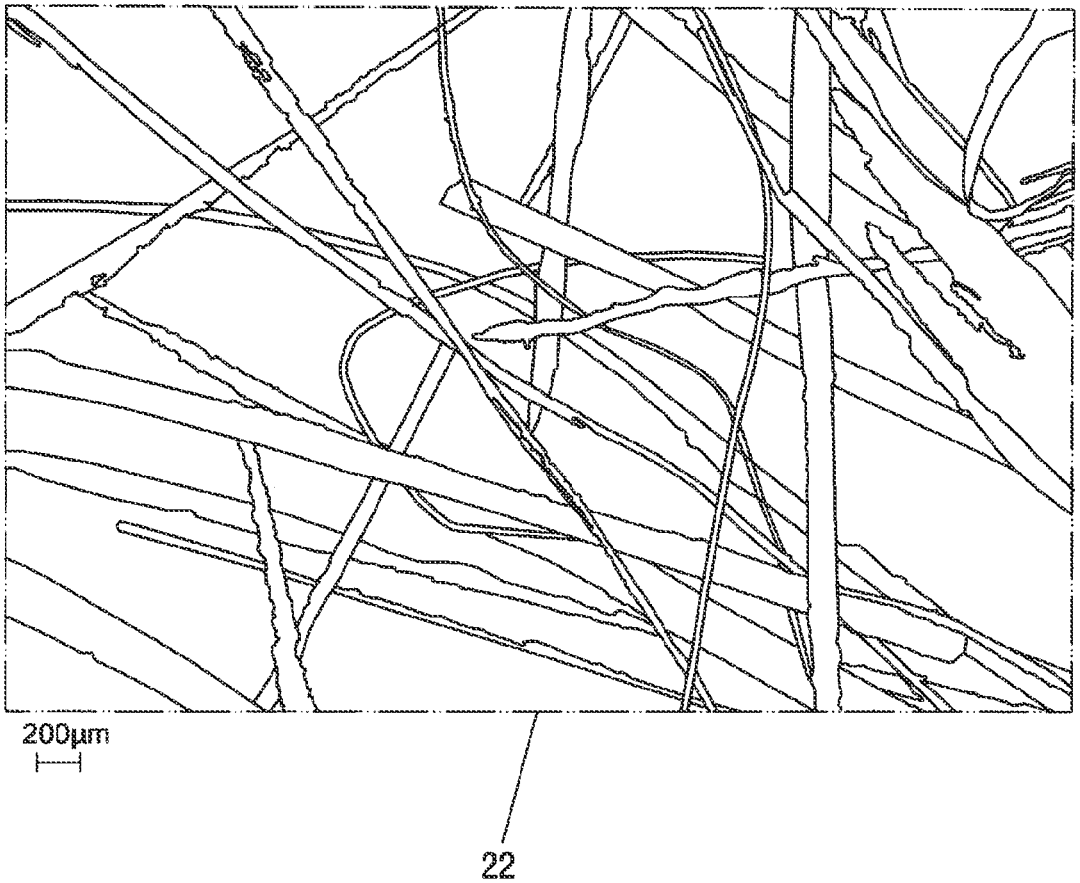
Figure 6:
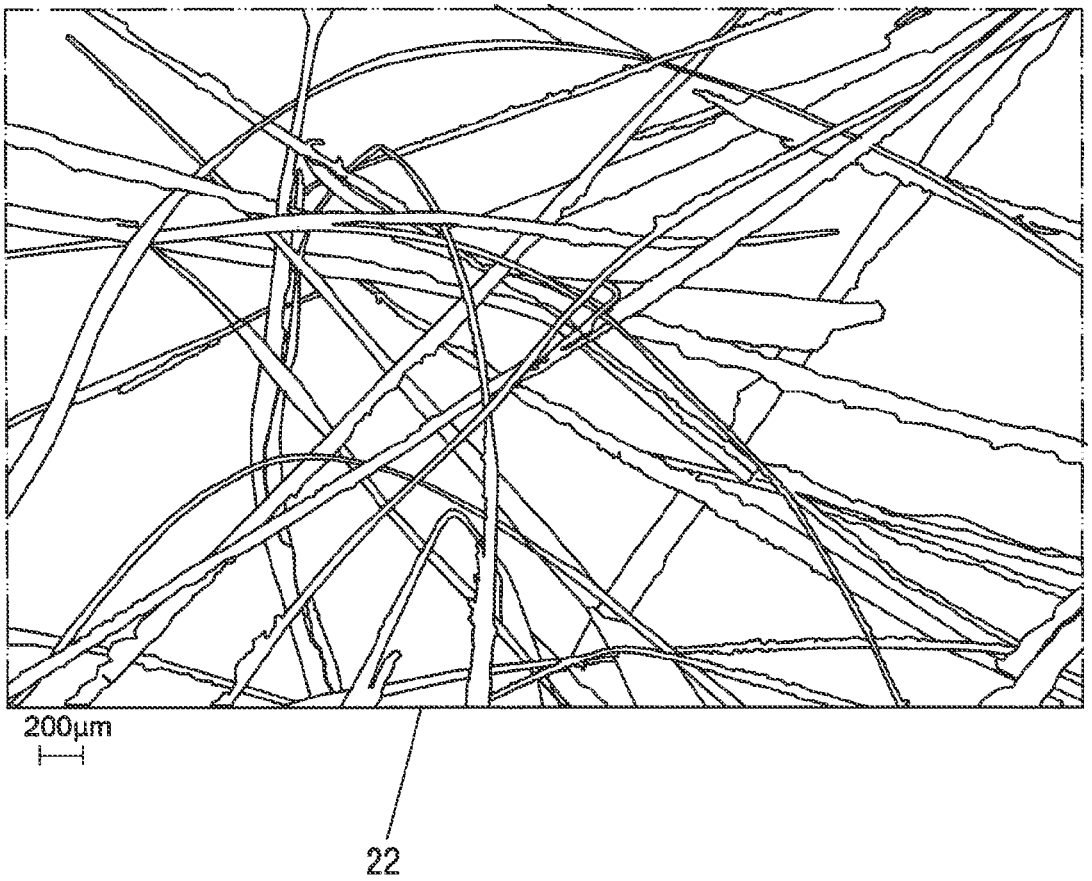
Figure 7:
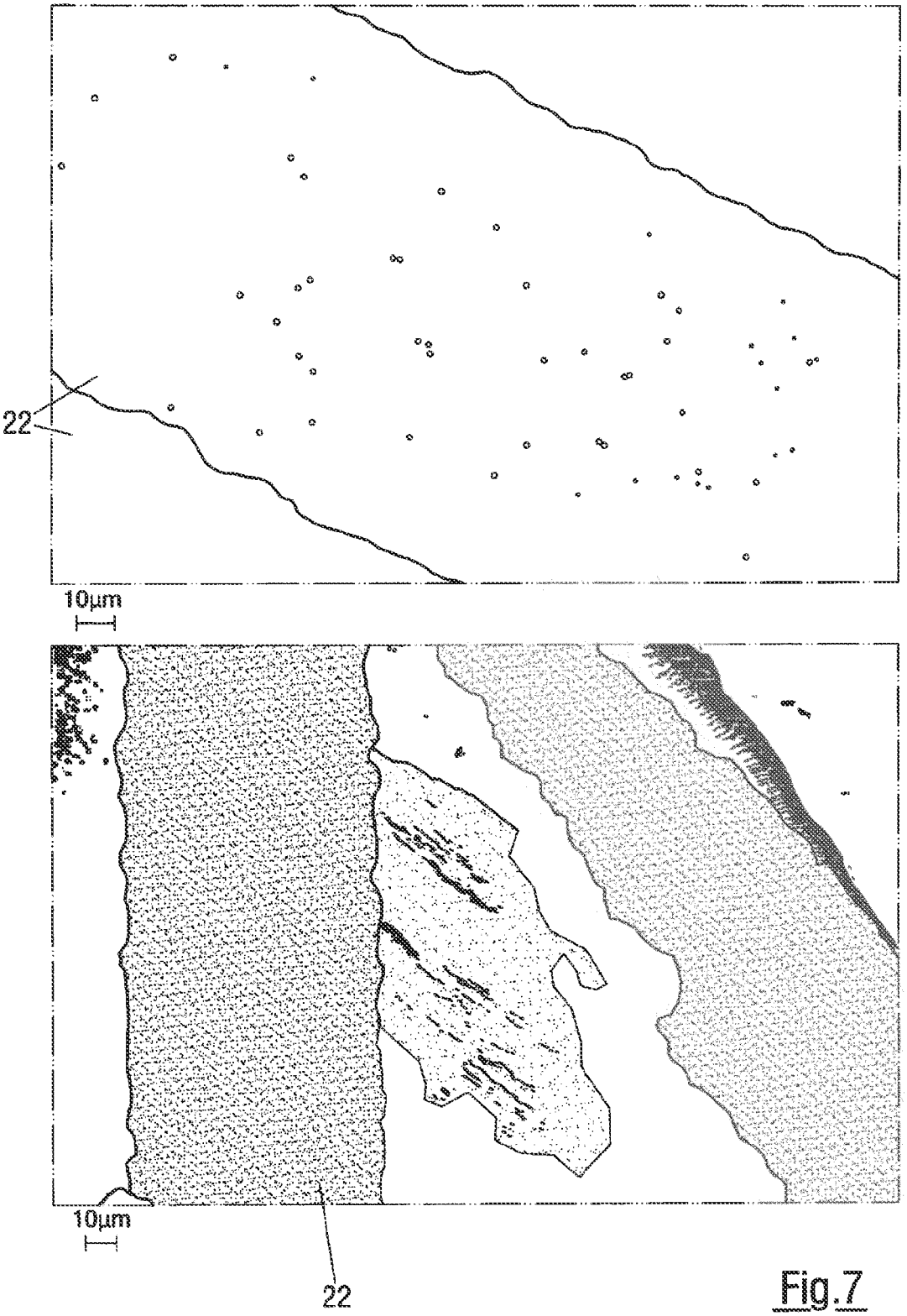
Figure 8:
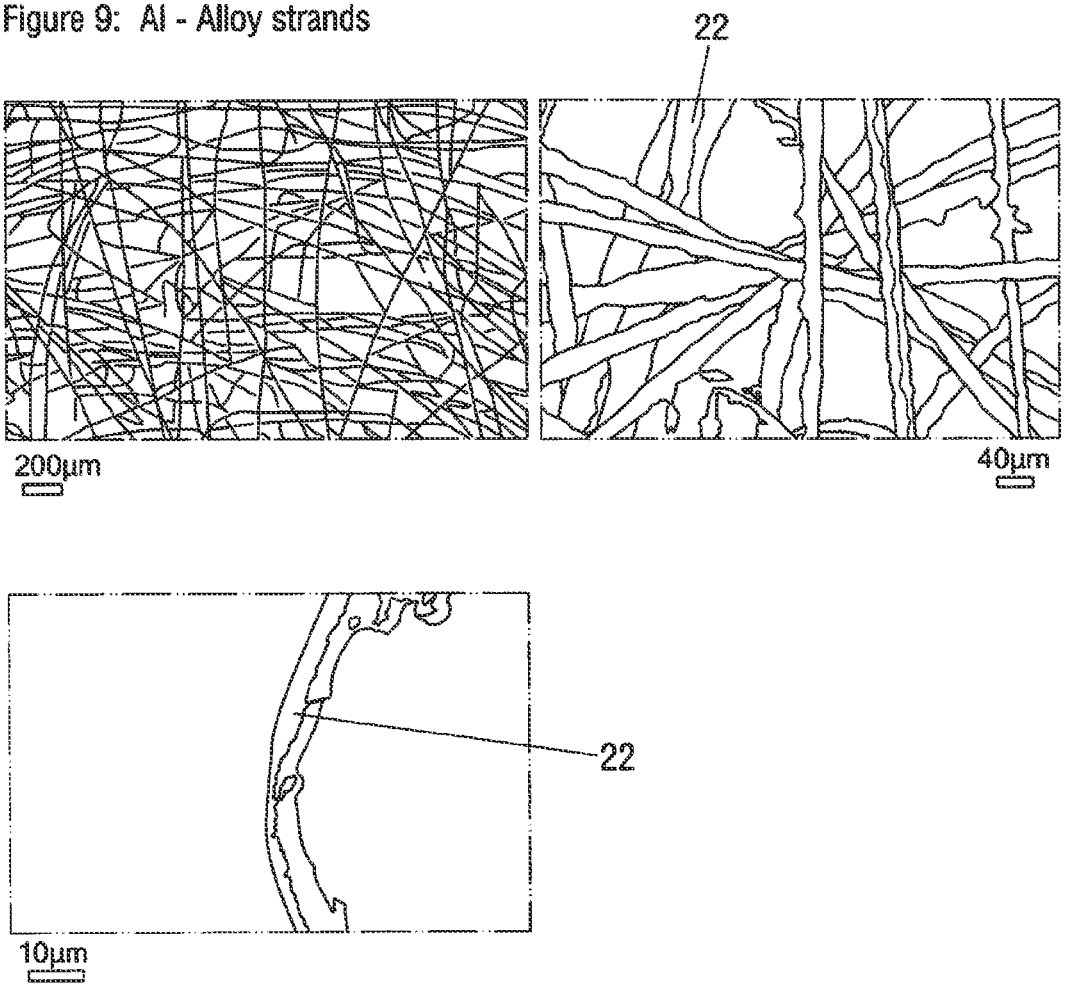

FIGS. 5 to 7 additionally show enlarged pictures of the fibers 22. One can see that the fibers 22 produced comprise a width of several tens to several hundreds of micrometers.

The fibers shown in FIGS. 4*b* to 7 were produced out of FeNiB with a nozzle 12 having a nozzle opening of 17×0,05 mm. The fibres 22 shown in FIG. 8 were produced out of an Al-alloy, whereas the fibres 22 shown in FIGS. 9 and 10 were produced out of a Cu-alloy.

Thus, it is noted that with an apparatus 10 according to the invention not only metal strands 22 can be produced, but also fibers 22, which are noticeably smaller in width.

Some distributions of the thicknesses and widths of the Al- and Cu-fibres 22 (see FIGS. 7 and 8) produced out of Al-alloy (FIG. 11) and out of a Cu-alloy (FIG. 12) with an apparatus 10 according to the invention are shown in FIGS. 11 and 12. One can see that the widths of the fibres 22 lie in the range of several tens to several hundreds of micrometers, whereas the thickness of these fibres 22 lies more in the range of 0,1 to 10 micrometers.

In detail, it can be seen in FIG. 11 that most of the fibres 22, which were produced out of an Al-alloy, could be produced with a width smaller than 50 μm with a thickness smaller than 2,5 μm. In FIG. 12, on the other hand, it can be seen that the fibres 22, which were produced out of a Cu-alloy, comprise widths which lie in the range of 70 to 200 μm with a corresponding thickness of about 1 to 8 μm. Hence, it could be shown that the choice of metal can have an impact on the width of the produced fibers.

A real life embodiment of the method to produce metal strands according to the invention is described in the following: casting molten metal 15 by defined flow on a fast rotating planar surface 16. In particular, this is obtained by mounting a melt spinning wheel 20 such that the rotation axis R is oriented approximately in line with the deposition direction D of the molten metal 15 originating from the opening 14 of a crucible; practically, the rotation axis R is oriented vertically and the top and bottom sides of the wheel rotate horizontally, i.e. parallel to the ground. This is why an apparatus 10 according to the invention can also be called a "horizontal melt spinner".

In the case of conventional melt spinner the rotation axis R is mounted perpendicular to the deposition direction D of molten metal 15 originating from the opening of a crucible 14. The rotation axis R is oriented horizontally and the sides of the wheel 20 are oriented vertically to the ground. This is why the well-known melt spinner are also called "vertical melt spinner".

In the case of the horizontal melt spinner 10 the motel metal 15 is dropped on one of the planar base surfaces 16 of the cylindrical wheel 20 which is the surface 16 through which the rotation axis R is aligned centrically and perpendicular to the rotating planar surface 16. This results in the pulling of centrifugal forces on the deposited melt 15 in a way which makes it more spread on the wheel's base surface 16 than in the case of dropping the melt on a circumferential surface of a rotating wheel of a vertical melt spinner. Consequently, the thickness of metal strands 22 is significantly reduced. The geometry of the metal strands 22 is not straight but curved along the elongation of the objects. The curvature is the one picked from the circular path on the base surface16 of the wheel 20 at which the metal melt 15 is deposited. The contact time of strands 22 is extended over the one obtained by traditional melt spinning. This cools the strands 22 more before leaving the rotating wheel 20. This reduces the damage of the wheel since less wheel material is moved from the surface 16 with the leaving strands 22.

Eventually, also the exchange and polishing of the wheel 20 is drastically simplified in case of the horizontal melt-spinner. Finally, the mechanical impact of the wheel 20 on its bearing is in favour of a more precise and stable rotation since nearly no momentum is placed on the rotation axis R.

A rotating wheel 20 or plate 30 has a circumference and two round base plates through which the rotating axis R points. It is the object of this invention to deposit the metal melt 15 not on the circumferential but on one of the base plate surfaces 16 at a distance from the rotation axis R. The rotation axis R and the metal deposition direction D will usually be the same but may also form an angle different from 0°. Thereby, centrifugal forces act on the molten metal 15 which wets the rotating wheel 20. In case of dropping metal 15 on a circumferential surface centrifugal forces point away from the surface working against wetting of the circumferential surface by the metal. In case of dropping molten metal 15 on one of the base plate surfaces 16 centrifugal forces on the molten metal 15 act along the surface 16. Thereby, flatting the metal liquid on the surface 16 and leaving it on the wheel 20 for longer times. In the case of to traditional melt spinner, on the other hand, the molten metal 15 is dropped on the circumferential surface and the melt is moved away from the circumferential surface due to the centrifugal forces.

REFERENCE SIGNS

10 apparatus
12 nozzle
14 nozzle opening
15 molten metal
16 planar surface
18 heating device
20 wheel
22 metal strand
24 collector
26 opening
28 adjustability
30 plate
34 recess
A alignment angle
C cooling device
D deposition direction
N nozzle direction
R axis of rotation

The invention claimed is:

1. A method of producing at least one of elongate metal strands and fibres with a crucible, the method comprising the steps of:

directing molten metal through a nozzle opening of a nozzle having a nozzle direction in a deposition direction at a regulated pressure difference between the inside and the outside of the crucible, wherein the pressure difference is selected in the range from 50 mbar to 1 bar and wherein the pressure outside of the crucible is kept below atmospheric pressure;

depositing said molten metal from said nozzle on a rotating planar surface having an axis of rotation, wherein a spacing between the nozzle opening and the rotating planar surface is selected in a range of 10 μm to 20 mm, wherein the nozzle and the rotating planar surface are mounted within a chamber having an atmosphere at a pressure corresponding to a lower pressure than ambient pressure;

entraining said molten metal in one plane about said axis of rotation via said rotating planar surface to form the at least one of elongate metal strands and fibres, wherein said rotating planar surface is aligned at an alignment angle with regard to the deposition direction during the entraining of the molten metal;

cooling said elongate metal strands to form solidified metal strands; and guiding said metal strands to collecting means to collect the solidified metal strands formed on the rotating planar surface.

2. The method according to claim 1, wherein the rotating planar surface is arranged perpendicular to the deposition direction during said steps of entraining and cooling said molten metal, and wherein the rotating planar surface comprises a circular, oval, quadratic, rectangular or triangular shape.

3. The method according to claim 1, wherein the alignment angle of the rotating planar surface is selected to lie in the range of 90° to 1° with respect to the deposition direction and/or the nozzle direction is selected to lie in the range of 0° to 90° with respect to the rotating planar surface.

4. The method according to claim 1, wherein the rotating planar surface is a base interface of a rotating wheel.

5. The method according to claim 1, wherein the axis of rotation is perpendicular to the rotating planar surface when the rotating planar surface is designed as a base interface of a rotating wheel.

6. The method according to claim 1, wherein the deposition position of the nozzle relative to the rotating planar surface is adjusted, while an orientation of the nozzle is of any direction.

7. The method according to claim 1, wherein the rotating planar surface is cooled.

8. An apparatus for producing elongate metal strands and fibres, the apparatus comprising:

a rotating planar surface mounted within a chamber having an atmosphere at a pressure corresponding to a lower pressure than ambient pressure, at least one nozzle mounted within the chamber having an atmosphere at a pressure corresponding to a lower pressure than ambient pressure, the at least one nozzle having a nozzle direction and a nozzle opening for directing molten metal in a deposition direction at a regulated pressure difference between the inside and the outside of the nozzle, wherein the pressure difference is selected in the range from 50 mbar to 1 bar, and wherein the pressure outside of the nozzle is kept below atmospheric pressure, onto the rotating planar surface, wherein a spacing between the nozzle opening and the rotating planar surface is selected in a range of 10 μm to 20 mm, the rotating planar surface being configured to move under an alignment angle with respect to said deposition direction to entrain and cool the molten metal in one plane via said movement of the rotating planar surface to form solidified elongate metal strands at said rotating planar surface, and collecting means configured to collect the solidified strands of metal formed on the rotating planar surface and separated from the rotating planar surface by a force generated by the movement of the rotating planar surface.

9. The apparatus according to claim 8, wherein the apparatus comprises a rotatable wheel.

10. The apparatus according to claim 8, wherein the rotating planar surface is aligned perpendicular to the deposition direction during the entraining of the molten metal.

11. The apparatus according to claim 8, wherein the rotating planar surface is aligned at an alignment angle with respect to the deposition direction during the entraining of the molten metal, wherein the alignment angle is selected to lie in the range of 90° to 1° and/or the nozzle direction is selected to lie in the range of 0° to 90° with respect to the rotating planar surface.

12. The apparatus according to claim 8, wherein the rotating planar surface rotates around an axis of rotation, which is aligned perpendicular to the rotating planar surface.

13. The apparatus according to claim 8, wherein a spacing between the nozzle opening and the rotating planar surface is at least 10 μm.

14. The apparatus according to claim 8, wherein the rotating planar surface comprises at least one exchangeable plate.

15. The apparatus according to claim 14, wherein a set of exchangeable plates is provided with each plate of the set of exchangeable plates being made from the same material as the remaining plates of the set of exchangeable plates, or wherein a variety of plates made from different materials is provided in the set of exchangeable plates.

16. The apparatus according to claim 8, wherein a deposition position of the nozzle is adjustable at least parallel to the rotating planar surface.

17. The apparatus according to claim 8, wherein the nozzle opening is of rectangular, circular, oval, quadratic or triangular geometry and is aligned in any direction with respect to the rotating planar surface.

18. The apparatus according to claim 8 comprising at least two nozzles, each nozzle having a nozzle opening for directing molten metal onto the rotating planar surface, wherein each nozzle is adjustable at least in parallel to the rotating planar surface.

19. The apparatus according to claim 18 that comprises between 4 and 12 nozzles.

20. The method according to claim 1, wherein the pressure outside of the crucible is kept at 400 mbar.

21. The method according to claim 1, wherein the spacing between the nozzle opening and the rotating planar surface is 50 μm, 100 μm, or 200 μm.

22. The method according to claim 1, wherein the thickness of the manufactured metal strands is less than 25 μm, especially less than 10 μm.

23. The method according to claim 1, wherein the manufactured metal strands comprise an aspect ratio of length to width from 2:1 up to 1000:1 or greater.

24. The method according to claim 1, wherein a collector is arranged in a direction transverse to a circumference of the rotating planar surface to intercept the solidified metal strands.

25. The apparatus according to claim 8, wherein the pressure outside of the crucible is kept at 400 mbar.

26. The apparatus according to claim 8, wherein the spacing between the nozzle opening and the rotating planar surface is 50 μm, 100 μm, or 200 μm.

27. The apparatus according to claim 8, wherein the thickness of the manufactured metal strands is less than 25 μm, especially less than 10 μm.

28. The apparatus according to claim 8, wherein the manufactured metal strands comprise an aspect ratio of length to width from 2:1 up to 1000:1 or greater.

29. The apparatus according to claim 8, wherein a collector is arranged in a direction transverse to a circumference of the rotating planar surface to intercept the solidified metal strands.

* * * * *